US009139936B2

(12) United States Patent
Meinecke et al.

(10) Patent No.: US 9,139,936 B2
(45) Date of Patent: Sep. 22, 2015

(54) OXIDATION FURNACE

(75) Inventors: Lars Meinecke, Herrenberg (DE); Karl Berner, Altdorf (DE); Markus Balzer, Geislingen (DE)

(73) Assignee: EISENMANN AG, Boeblingen (DE)

( * ) Notice: Subject to any disclaimer, the term of this patent is extended or adjusted under 35 U.S.C. 154(b) by 226 days.

(21) Appl. No.: 13/983,348

(22) PCT Filed: Jan. 12, 2012

(86) PCT No.: PCT/EP2012/000116

§ 371 (c)(1),
(2), (4) Date: Oct. 2, 2013

(87) PCT Pub. No.: WO2012/104011

PCT Pub. Date: Aug. 9, 2012

(65) Prior Publication Data

US 2014/0026437 A1 Jan. 30, 2014

(30) Foreign Application Priority Data

Feb. 3, 2011 (DE) ..... 10 2011 010 298

(51) Int. Cl.

| | |
|---|---|
| ***F26B 13/00*** | (2006.01) |
| ***D01F 9/12*** | (2006.01) |
| ***F27B 9/28*** | (2006.01) |
| ***D01F 9/32*** | (2006.01) |

(52) U.S. Cl.
CPC .. *D01F 9/12* (2013.01); *D01F 9/32* (2013.01); *F27B 9/28* (2013.01)

(58) Field of Classification Search
CPC ..... F26B 13/00; F26B 9/32; F26B 9/00; F27B 9/00; F27B 9/28
USPC ..... 34/232, 634, 640; 432/8, 56
See application file for complete search history.

(56) References Cited

U.S. PATENT DOCUMENTS

| | | | | | |
|---|---|---|---|---|---|
| 4,143,468 | A | * | 3/1979 | Novotny et al. | 34/276 |
| 4,515,561 | A | * | 5/1985 | Melgaard | 432/136 |
| 4,559,010 | A | * | 12/1985 | Katsuki et al. | 432/59 |
| 5,142,796 | A | * | 9/1992 | Anzai et al. | 34/62 |
| 5,263,265 | A | * | 11/1993 | Melgaard | 34/421 |
| 5,358,166 | A | * | 10/1994 | Mishina et al. | 228/42 |
| 5,908,290 | A | * | 6/1999 | Kawamura et al. | 432/59 |
| 6,776,611 | B1 | | 8/2004 | Sprague | |

(Continued)

FOREIGN PATENT DOCUMENTS

| | | | |
|---|---|---|---|
| DE | 1 059 097 | * | 6/1959 |
| DE | 102011010298 | * | 6/2012 |

(Continued)

*Primary Examiner* — Stephen M Gravini
(74) *Attorney, Agent, or Firm* — Factor Intellectual Property Law Group, Ltd.

(57) ABSTRACT

An oxidation furnace for the oxidative treatment of fibers, in particular for producing carbon fibers, with a housing which is gas-tight, apart from passage areas for the carbon fibers, and a process chamber located in the interior of the housing. Hot air can be blown into the process chamber by at least one air inlet device. Deflecting rollers flanking the process chamber guide the fibers arranged side by side in the form of a carpet through the process chamber in a serpentine manner, wherein each fiber carpet spans a plane between opposite deflecting rollers. The air inlet device allows hot air to be diverted to the side of the deflecting rollers facing away from the process chamber such that hot air flows over the respective deflecting roller and the fibers before it enters the process chamber.

16 Claims, 14 Drawing Sheets

(56) References Cited

U.S. PATENT DOCUMENTS

| | | | | |
|---|---|---|---|---|
| 7,335,018 | B2 * | 2/2008 | Yamaguchi | 432/59 |
| 2007/0077840 | A1 * | 4/2007 | Chen et al. | 442/337 |
| 2007/0227034 | A1 * | 10/2007 | Ogawa et al. | 34/444 |
| 2012/0304479 | A1 * | 12/2012 | Berner | 34/203 |
| 2012/0304480 | A1 * | 12/2012 | Berner | 34/203 |
| 2013/0171578 | A1 * | 7/2013 | Berner | 432/199 |
| 2013/0212899 | A1 * | 8/2013 | Haimer et al. | 34/239 |
| 2014/0026437 | A1 * | 1/2014 | Meinecke et al. | 34/634 |

FOREIGN PATENT DOCUMENTS

| | | | | |
|---|---|---|---|---|
| EP | 0 426 858 | A1 | 5/1991 | |
| GB | 805303 | * | 12/1958 | |
| JP | 55102452 | A * | 8/1980 | B04C 5/20 |

* cited by examiner

OXIDATION FURNACE

RELATED APPLICATIONS

This application claims the filing benefit of International Patent Application No. PCT/EP2012/000116, filed Jan. 12, 2012, which claims the filing benefit of German Patent Application No. 10 2011 010 298.1 filed Feb. 3, 2011, the contents of both of which are incorporated herein by reference.

FIELD OF THE INVENTION

The invention relates to an oxidation furnace for the oxidative treatment of fibres, in particular for producing carbon fibres, having a) a housing which, apart from passage regions for the carbon fibres, is gas-tight;
b) a process chamber located in the interior of the housing;
c) at least one air infeed device by means of which hot air may be blown into the process chamber;
d) deflecting rollers which flank the process chamber (28) and guide the fibres, in the form of a carpet, through the process chamber next to one another in serpentine manner, with the carpet of fibres spanning a respective plane between opposing deflecting rollers.

BACKGROUND OF THE INVENTION

In known oxidation furnaces of this type, the deflecting rollers may be arranged either in the interior of the housing or outside the housing. In this case, the air infeed device is configured such that hot air is emitted into a region between the deflecting rollers and the process chamber, in a direction towards the process chamber. This has the effect that the carbon fibres cool somewhat as they pass over a deflecting roller, since they have left the process chamber and moreover are no longer acted upon by hot air emitted by the air infeed device.

This means that, once the fibres have been deflected by a deflecting roller and re-enter the process chamber, some of the energy of the furnace has first to be applied to re-heating the fibres to the temperature required for the oxidation procedure.

In particular, if the deflecting rollers are located outside the furnace housing in the ambient atmosphere of the oxidation furnace, a high percentage—which in extreme cases may be up to 80%—of the energy required for operating the oxidation furnace may be consumed purely in heating the fibres up to the required oxidation temperature again.

It is thus an object of the invention to provide an oxidation furnace of the type mentioned at the outset in which the use of energy is more favourable.

SUMMARY OF THE INVENTION

This object may be achieved with an oxidation furnace of the type mentioned at the outset, in that e) the air infeed device is set up such that hot air is fed to the side of the deflecting rollers remote from the process chamber, with the result that hot air there flows over the respective deflecting roller and the fibres before it enters the process chamber.

This directed flow of hot air has the effect of keeping the temperature of the deflecting rollers and the fibres guided thereover at a higher value until the fibres re-enter the process chamber. In the ideal case, as the fibres pass over the deflecting rollers they still remain at a process temperature at which the oxidation can be performed.

During this, it is favourable if the deflecting rollers are arranged in a deflecting region of the housing which is separated, at least from the point of view of fluid mechanics, from the process chamber. In this way, it is possible to provide for a constant temperature at the deflecting rollers regardless of flow in the process chamber.

During the oxidation process, exhaust air is guided out of the process chamber. On the one hand the hot air may additionally be used to compensate for the volume that has been guided away. On the other, the hot air contributes to maintaining the process temperature in the process chamber in an energy-efficient way, since the region of the process chamber in which the hot air enters the latter does not cool down. If there are flow guide means between the deflecting region and the process chamber, the hot air may be guided out of the air infeed device to the process chamber and to the different planes of the carpet of fibres in a controlled manner.

If the deflecting rollers can be screened from the ambient atmosphere of the oxidation furnace by a housing element, no heat exchange or only reduced heat exchange with the atmosphere around the oxidation furnace takes place. This allows the effectiveness to be improved.

It is favourable if the housing element is arranged on the side of the deflecting rollers remote from the process chamber such that a flow channel for hot air is formed between the housing element and the deflecting roller.

If the housing element is made from glass, the deflecting region may be viewed from the outside, and a visual check may be made at all times of whether or not the fibres are running on the deflecting rollers properly.

It is particularly advantageous if access from the outside to at least one deflecting roller may be freed by means of the housing element. This takes account of the fact that as individual carbon fibres pass through the oxidation furnace they may tear. Conventionally, the loose end of a torn fibre is linked in the region of the deflecting rollers with a fibre running next to it, and the latter drags the torn fibre through the furnace with it. For this, however, it is necessary for the deflecting rollers to be accessible from the outside.

For this, it has proved advantageous if at least one housing element is a plate that is mounted to pivot about a horizontal axis.

As an alternative or in addition, at least one housing element may be a detachably fastened removable plate.

Similarly as an alternative or in addition, at least one housing element may be a trough element that is slipped over the deflecting roller from the side of the deflecting roller that is remote from the process chamber.

Furthermore, it may be advantageous if at least one housing element is a fin-like element that is mounted to turn about a vertical axis.

If a maintenance person is to take hold of a loose end of a torn fibre and link it with another fibre, the temperature in the region of the deflecting rollers and also the temperature of the deflecting rollers themselves and the fibres running thereon must not be so high that the maintenance person could be injured. For this reason, it is favourable if the air infeed device is set up such that hot air may optionally be fed or not fed to the side of one of the deflecting rollers remote from the process chamber, or if, instead of hot air, cool air may be fed to the side of one of the deflecting rollers remote from the process chamber. If the air flow can be interrupted, or by the infeed of cool air, the region that has to be accessed by the maintenance person can cool down and access from the outside is possible without risk.

For this purpose, it is favourable if the air infeed device includes a plurality of air infeed boxes which are arranged between the planes of the carpet of fibres and are fed from a fresh air source.

Air infeed boxes of this kind may then be displaced in the horizontal direction between an operational position, in which they emit hot air to the side of the deflecting rollers remote from the process chamber, and a maintenance position which is different therefrom.

As an alternative, the air infeed boxes may cooperate with air guidance boxes that can be removed from the deflecting region. Hot air is then only fed to the deflecting rollers when the air guidance boxes are present.

In a modification, the air infeed device includes a plurality of flap elements which are arranged between the planes of the carpet of fibres, are fed from a fresh air source and emit hot air through an exit slot, wherein the flap elements may be pivoted about a horizontal axis between an operational position, in which the exit slot is arranged close to a plane of the carpet of fibres, and a maintenance position, in which the exit slot lies further away from this plane.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained below in more detail with reference to the drawings, in which.

DETAILED DESCRIPTION OF THE PRESENT INVENTION

Figure 1:
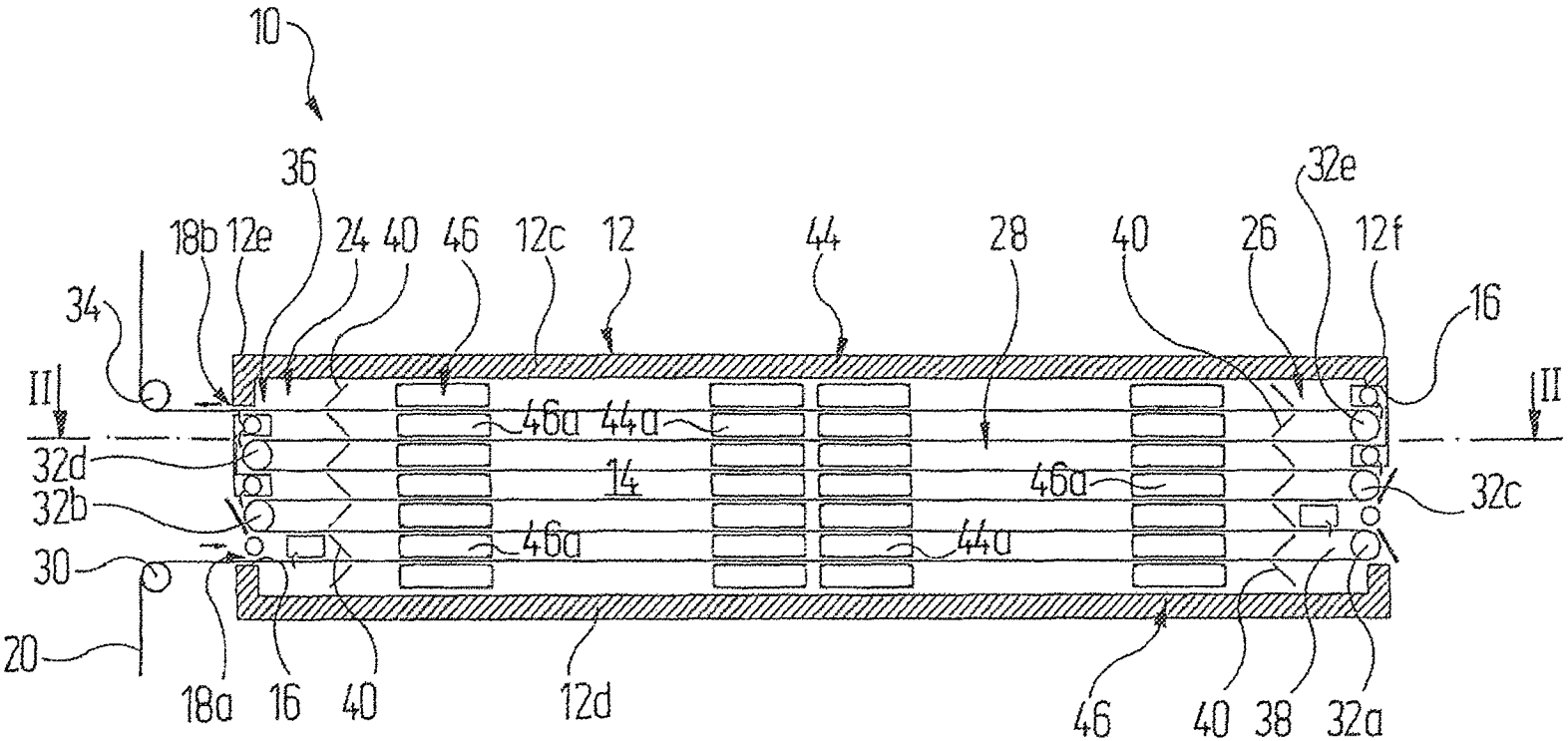
FIG. 1 shows a vertical section through an oxidation furnace for producing carbon fibres, in the longitudinal direction of the furnace.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference will first be made to FIGS. 1 to 4. These show a first exemplary embodiment of an oxidation furnace 10 which is used to produce carbon fibres.

The oxidation furnace 10 includes a housing 12 which delimits a passage chamber 14, forming the interior of the oxidation furnace 10, by means of two vertical longitudinal walls 12*a*, 12*b*, a top wall 12*c* and a bottom wall 12*d*. At its end sides 12*e* and 12*f*, the housing 12 has a respective opening 16 through which the passage chamber 14 is always accessible from the outside. Fibres 20 are guided into the passage chamber 14 and out of it again through permanent passages 18*a*, 18*b* in the region of the end side 12*e* on the left as seen in FIGS. 1 and 2.

Figure 2:
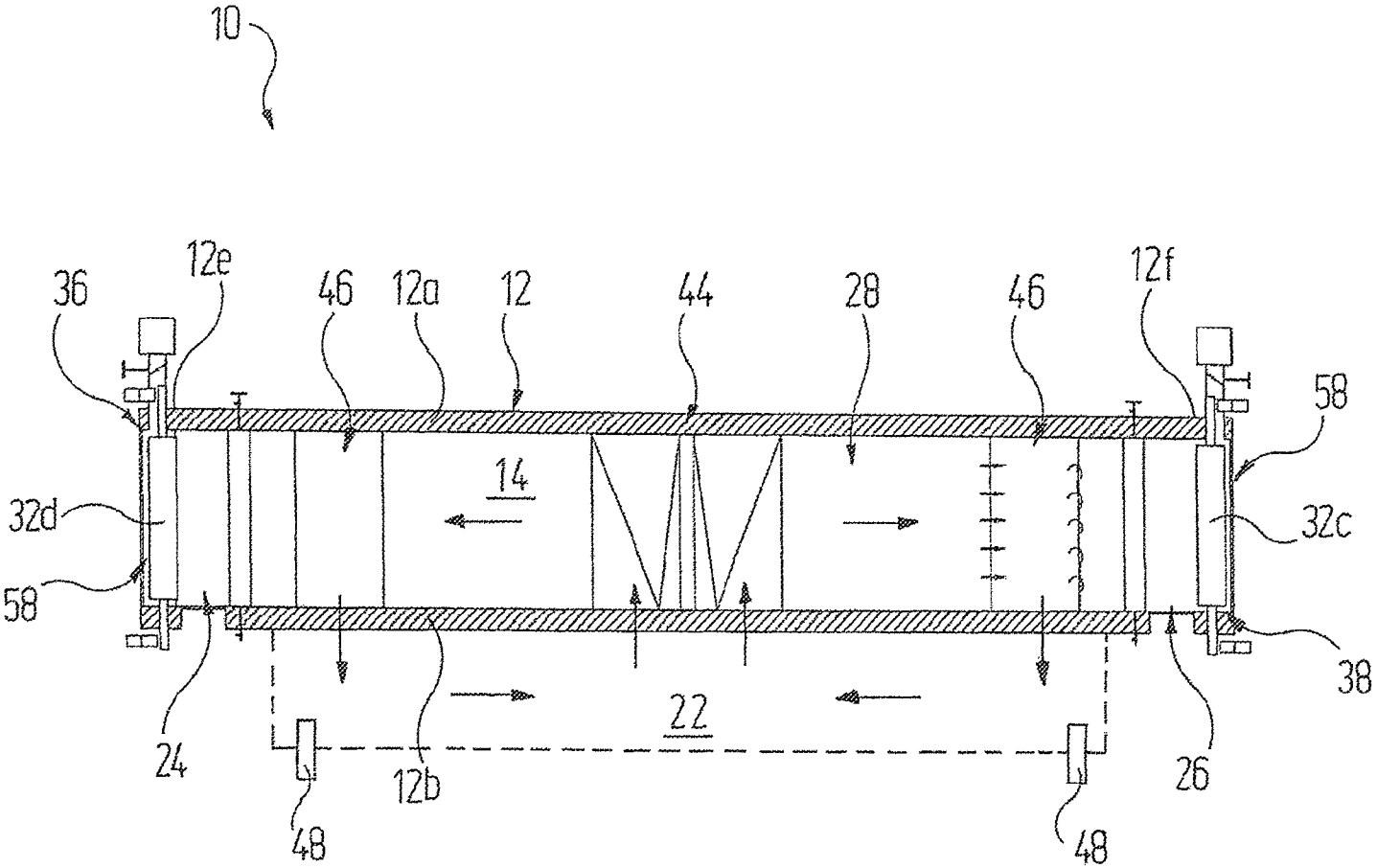
FIG. 2 shows a horizontal section through the oxidation furnace in FIG. 1, along the line of section II-II there.

The vertical longitudinal wall 12*b* separates the passage chamber 14 from an air guidance chamber 22 which lies laterally thereto and whereof the delimitation is merely partly indicated in FIG. 2, even there only by dashed lines.

The passage chamber 14 is for its part divided in the longitudinal direction into three regions, and includes a first deflecting region 24, which is adjacent to the end side 12*e*, a second deflecting region 26, which is adjacent to the opposing end side 12*f*, and a process chamber 28 which is located between the deflecting regions 24, 26.

The fibres 20 to be treated are fed to the passage chamber 14 of the oxidation furnace 10 in a parallel course, as a type of "carpet". For this purpose, the fibres 20 enter the first deflecting region 24, guided over a guide roller 30 which is mounted outside the furnace housing 12, through the passage 18*a* in a lower region of the opening 16 of the end side 12*e*. The fibres 20 are then guided through the process chamber 28 and the second deflecting region 26 and back from there again.

Overall, the fibres 20 pass through the process chamber 28 in a serpentine manner over upwardly successive deflecting rollers 32 which are designated 32*a*, 32*b*, 32*c*, 32*d*, 32*e*, following the course of the fibres from bottom to top. Here, three deflecting rollers 32*a*, 32*c*, 32*e* lying with their axes parallel and above one another are provided in the second deflecting region 26 of the oxidation furnace 10, and two such deflecting rollers 32*b*, 32*d* are provided in the first deflecting region 24. Between the deflecting rollers 32*a*, 32*b*, 32*c*, 32*d*, 32*e*, the carpet of fibres that is formed by the fibres 20 spans a respective plane.

After the topmost passage through the passage chamber 28 and the first deflecting region 24, the fibres 20 leave the oxidation furnace 10 through the passage 18*b*, which is in the upper region of the opening 16 of the end side 12*e*. The fibres 20 are guided over a further guide roller 34, outside the furnace housing 12.

The first deflecting region 24 thus at the same time forms an entry and exit airlock for the fibres 20 passing into the passage chamber 14 and the process chamber 28.

Associated with the first deflecting region 24 is a first air infeed device 36, and associated with the second deflecting region 26 is a second air infeed device 38, and fibres 20 pass through these on their respective path through the first and the second deflecting regions 24 and 26. Pre-heated fresh air is fed to the process by the air infeed devices 36, 38; further details will additionally be given below regarding the air infeed devices 36, 38.

Located between the deflecting regions 24, 26 and the process chamber 28, and arranged one above the other as flow guide means, are air guide flaps 40, which are respectively located between the planes spanned by the carpet of fibres 20 and which extend between the longitudinal walls 12*a*, 12*b* of the furnace housing 12. Each air guide flap 40, coupled individually or by way of a linkage rod, is pivotal about a respective horizontal pivot axis 42, which passes through the longitudinal walls 12*a*, 12*b* of the furnace housing 12 and is mounted outside the latter. This can be seen in FIG. 2.

Two opposing air flows are maintained in the process chamber 28. For this purpose, an infeed blower device 44 is arranged in the central region of the process chamber 28 and a respective suction device 46 is arranged in the two outer end regions of the process chamber 28, adjacent to the respective air guide flaps 40. The infeed blower device 44 and includes a plurality of infeed blower boxes 44*a*, and the suction devices 46 include a plurality of suction boxes 46*a*, which are respectively arranged between the planes spanned by the carpet of fibres 20 and extend between the longitudinal walls 12*a*, 12*b* of the furnace housing 12, and of which only some are provided with reference numerals.

Starting for example from the suction devices 46, the air is conveyed into the air guide chamber 22, where it is prepared and conditioned in a manner which is of no further interest here. From the air guide chamber 22, the air in each case arrives at the infeed blower device 44. The latter emits the conditioned air, flowing in opposing directions towards the deflecting regions 24 and 26, into the process chamber 28. In the latter, the air flows in opposing directions to the suction devices 46, as a result of which two circulating air flows form closed circuits, illustrated in FIG. 2 by corresponding arrows.

During the serpentine passage of the fibres 20 through the process chamber 28, they are thus flushed with hot oxygen-containing air and hence oxidised. The precise construction of both the infeed blower device 44 and the suction devices 46, and the path of flow of the air from the infeed blower device 44 to the suction devices 46, are of no further concern in the present document.

Further provided in the region of the air guide chamber 22 are two outlets 48. The gas or air volumes which are either produced during the oxidation process or which enter the process chamber 28 as fresh air through the air infeed devices 36, 38 are removed through these outlets 48 in order in this way to maintain the air balance in the oxidation furnace 10. The removed gases, which may also comprise toxic constituents, are fed to a thermal post-combustion step. The heat recovered during this may be used at least for pre-heating the fresh air fed to the oxidation furnace 10.

In relation to the air infeed devices 36, 38 and the infeed blower device 44 interacting with the suction devices 46 and the air guide chamber 22, the deflecting regions 24, 26 and the process chamber 28 are thus separated from one another from the point of view of fluid mechanics by the air guide flaps 40.

Figure 3:
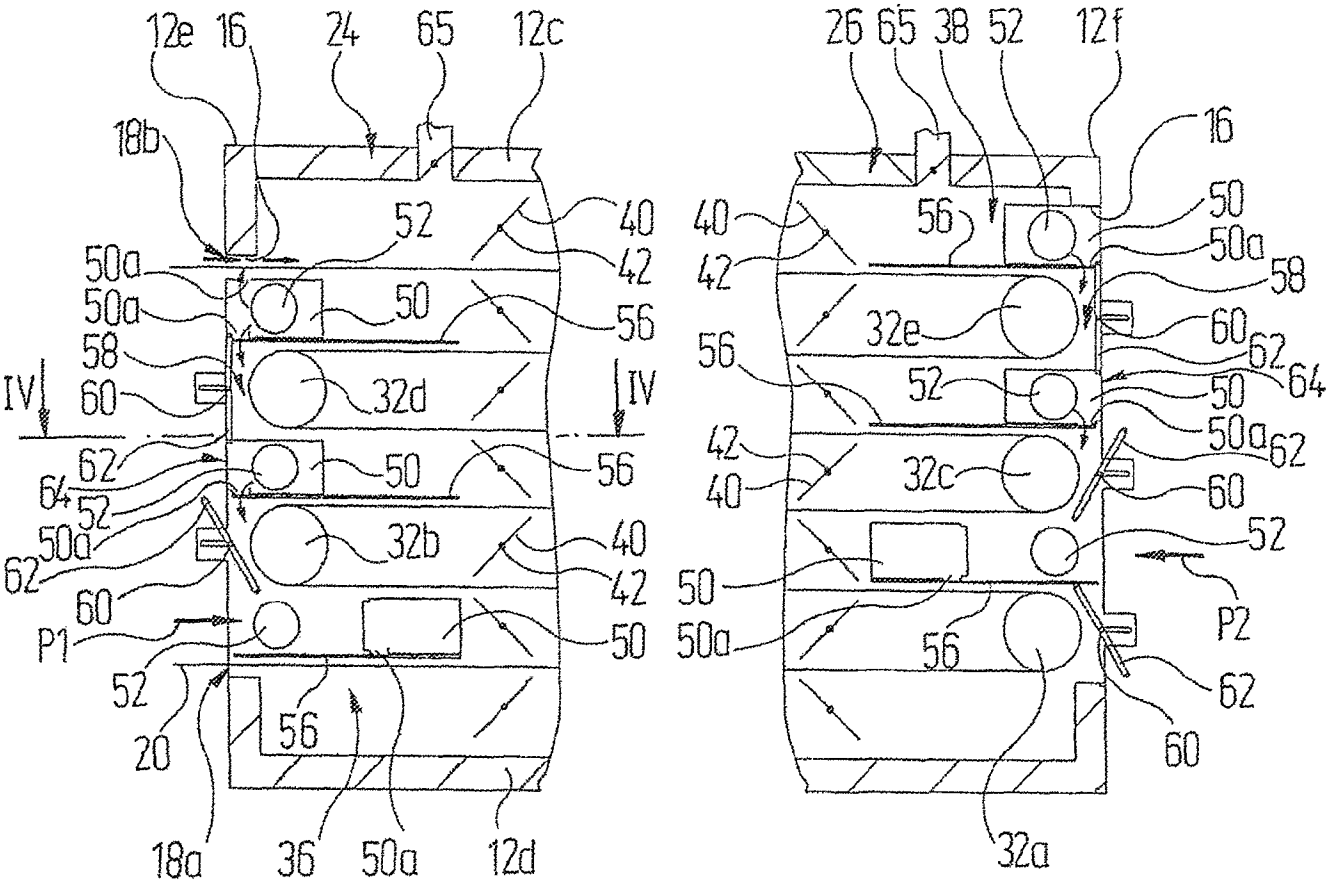
FIG. 3 shows vertical sections, corresponding to the section in FIG. 1, through deflecting regions at opposing ends of the oxidation furnace, on a larger scale.
Figure 4:
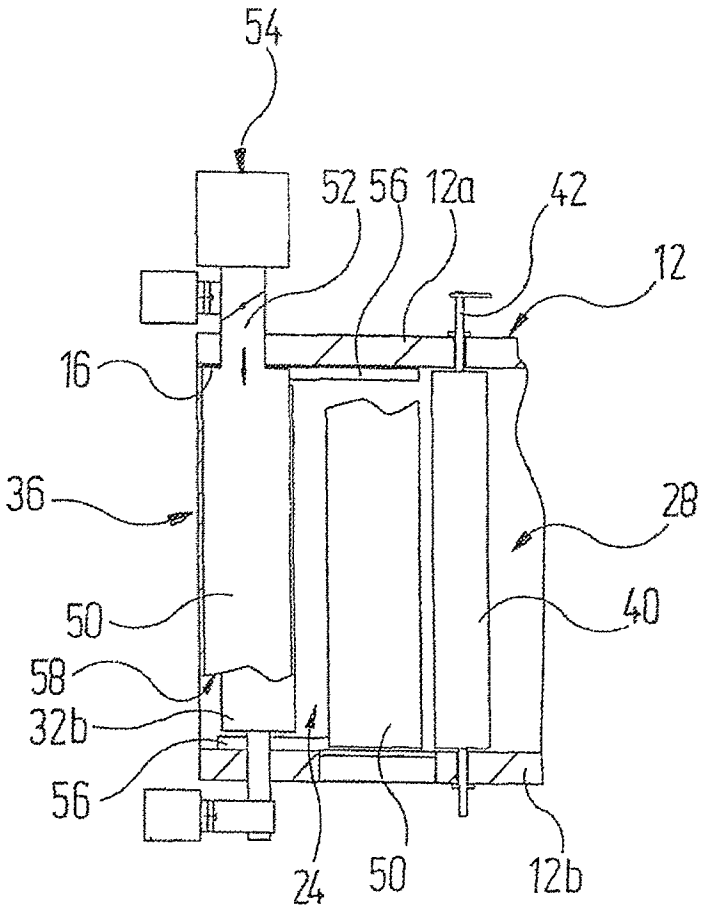
FIG. 4 shows a horizontal section through an airlock deflecting region according to FIG. 3, along the line of section IV-IV there, wherein an infeed blower box is shown partly cut away.

FIG. 3 shows the deflecting regions 24, 26 and FIG. 4 shows the first deflecting region 24 on a larger scale.

As can be seen from FIG. 3, in the first deflecting region 24, respectively at a level below the first deflecting roller 32*b*, between the two deflecting rollers 32*b*, 32*d* and above the upper deflecting roller 32*d*, there are arranged air infeed boxes 50 of the first air infeed device 36 which are of rectangular cross-section and extend between the longitudinal walls 12*a*, 12*b* of the furnace housing 12 and perpendicular thereto.

In the second deflecting region 26, respectively at a level above the lower deflecting roller 32*a*, between the two deflecting rollers 32*a*, 32*c* and above the upper deflecting roller 32*e*, there are arranged corresponding air infeed boxes 50 of the second air infeed device 38 which are similarly of rectangular cross-section.

Each air infeed box 50 is connected to a fresh air source 54 by way of its own duct connection piece 52, having a flap valve, and the air infeed boxes 50 can be fed with conditioned pre-heated fresh air from these. The air infeed boxes 50 each have, on their side pointing towards the end sides 12*e* or 12*f* of the furnace housing 12, exit slots 50*a* which extend in the longitudinal direction of the respective air infeed box 50 and through which fresh air which is fed in exits upwards and/or downwards.

Here, only the air infeed box which is arranged in the first deflecting region 24 below the topmost plane of the carpet of fibres 20 has two exit slots 50*a*, so that hot air can exit both upwards and downwards. All the other air infeed boxes 50 have only one exit slot 50*a*, through which hot air is emitted downwards to the plane of the carpet of fibres 20 extending below the respective air infeed box 50. This is illustrated in FIG. 3 by corresponding arrows in the deflecting regions 24, 26, although these are not given separate references.

The air infeed boxes 50 are moreover mounted on guide rails 56 which extend horizontally and are attached to the longitudinal walls 12*a*, 12*b* of the furnace housing 12. The air infeed boxes 50 may be displaced horizontally on the guide rails 56 between an operational position and a maintenance position.

In their operational position, the air infeed boxes 50 are connected to their respective duct connection piece 52 and are set up such that the fresh air coming out of the exit slots 50*a* is fed to the side 58 of the deflecting rollers 32*a*, 32*b*, 32*c*, 32*d*, 32*e* remote from the process chamber 28. There, the hot air flows over the respective deflecting roller 32*a*, 32*b*, 32*c*, 32*d*, 32*e* and the fibres 20 before it enters the process chamber 28, and then flows on through the deflecting region 24 or 26 to the air guide flaps 40. This is shown by the example of the upper air infeed boxes 50, of which there are in each case two in FIG. 3, in the deflecting regions 24, 26.

In their maintenance position, the air infeed boxes 50 are displaced away from the deflecting rollers 32*b*, 32*d* and 32*a*, 32*c*, 32*e* respectively and towards the air guide flaps 40, during which they are separated from the associated duct connection piece 52, as illustrated by the example of the air infeed boxes 50 in each case nearest the bottom in the figure, in the deflecting regions 24, 26. In the maintenance position, the air infeed boxes 50 are thus no longer fed with hot fresh air.

In a modification, the duct connection piece 52 may also be of flexible construction and be carried along with the respective air infeed box 50.

In front of each deflecting roller 32*b*, 32*d* and 32*a*, 32*c*, 32*e*, glass plates 62 which are each pivotal about a horizontal axis 60 between an open position and a closed position are mounted on the end sides 12*e*, 12*f* of the furnace housing 12. In FIG. 3, the glass plates 62 in front of the deflecting rollers 32*d* and 32*e* are shown in the closed position, and the glass plates 62 in front of the deflecting rollers 32*a*, 32*b*, 32*c* are shown in the open position.

The glass plates 62 screen the deflecting regions 24, 26 from the ambient atmosphere of the oxidation furnace 10. The deflecting regions 24, 26 can moreover be viewed from outside through the glass plates 62, with the result that it is possible at all times to check whether the fibres 20 are guided properly by the deflecting rollers 32.

When the glass plates 62 adopt their closed position at the end sides 12*e*, 12*f*, a spacing 64 is left in each case between two vertically adjacent glass plates 62, and this spacing 64 is of approximately the order of magnitude of the height of the air infeed boxes 50. The air infeed boxes 50 engage in sealing manner in this intermediate space 64 when they adopt their operational position. For this purpose, the contours of the glass plates 62 and the air infeed boxes 50 are of mutually complementary construction in the interacting regions and are provided with sealing means, in a manner known per se.

In normal operation of the oxidation furnace 10, the air infeed boxes 50 adopt their operational position and the glass plates 62 are tilted into their closed position. Apart from the said passages 18*a*, 18*b* for the fibres 20, in this arrangement of the air infeed boxes 50 and the glass plates 62 the openings 16 at the end sides 12*e*, 12*f* of the furnace housing 12 are thus closed in gas-tight manner. The interacting components thus form end walls of the furnace housing 12.

The flap valves in the duct connection pieces 52 are opened and the air infeed boxes 50 of the air infeed devices 36, 38 are thus fed with hot fresh air from the fresh air source 54. This hot fresh air flows out of the exit slots 50*a* of the air infeed boxes 50, first to the side 58 of the deflecting rollers 32*a*, 32*b* and 32*c*, 32*d*, 32*e* remote from the process chamber 28 and past the inner face of the glass plates 62 before flowing to the air guide flaps 40 and on into the process chamber 28.

During this, hot fresh air flows around the whole of the deflecting rollers 32*b*, 32*d* and 32*a*, 32*c*, 32*e* and the fibres 20 guided thereon. This prevents the deflecting rollers 32*b*, 32*d* and 32*a*, 32*c*, 32*e* and the fibres 20 guided thereon from cooling in the deflecting regions 24, 26 outside the process chamber 28 and from needing first to be heated up to the process temperature required for the oxidation procedure when they enter the process chamber 28 for the first time or again.

Moreover, the inner faces of the glass plates 62 are heated by the hot fresh air, thereby preventing undesirable condensate from the carbon fibres 20 from being deposited there.

If the furnace housing 12 has additional, for example laterally arranged, glass plates to enable viewing of or access to the deflecting regions 24, 26, the air infeed boxes 50 may have further correspondingly arranged outlet openings through which hot air can be fed to these glass plates, so that the formation of condensate is prevented there too.

In operation of the oxidation furnace 10, each air guide flap 40 adopts a position in which only a small gap is left between the upper and lower edge thereof and the carpet of fibres 20 running past, in order to separate the deflecting regions 24, 26 from the process chamber 28 by as high a flow rate of the inflowing hot air as possible. In addition, in this way it is possible to ensure good contact between the carpet of fibres 20 and the hot fresh air.

If the case mentioned at the outset occurs, that a carbon fibre 20 tears, the torn fibre 20 can still be linked with an adjacent fibre 20 while the oxidation process is under way, since on the one hand the deflecting regions 24 and 26 are accessible from outside by way of the glass plates 62 and on the other the air infeed devices 36, 38 are set up such that the deflecting rollers 32*b*, 32*d* and 32*a*, 32*c*, 32*e* and the fibres 20 guided thereon can cool to a temperature at which they can be touched and handled by a maintenance person without risk.

In the upper section of the deflecting regions 24, 26, in each case a suction connection piece 65 having a valve flap is also provided, and through this suction connection piece 65 the hot air in the deflecting region 24, 26 can be removed rapidly by suction by means of a suction device (not shown individually). As a result of this, cooling of the deflecting rollers 32 and the carbon fibres 20 can be speeded up.

The location of a loose end of a torn carbon fibre 20 may be detected by means of known sensor techniques. From this it is possible to deduce which of the deflecting rollers 32*a*, 32*b*, 32*c*, 32*d*, 32*e* the loose end of the torn fibre 20 will be guided over next. For example, let us assume that the loose end of the torn fibre 20 will arrive next at the bottommost deflecting roller 32*b* in the first deflecting region 24.

In this case, the duct connection piece 52 that leads to the bottommost air infeed box 50 in the first deflecting region 24 is closed. This air infeed box 50 is then displaced into its maintenance position, as shown in FIG. 3. As a result, the region of the passage 16 in which the relevant air infeed box 50 was arranged becomes free. On the one hand this already provides a maintenance person with access to the deflecting roller 32*a* from the outside. On the other, a flow path for cooler ambient air from the ambient atmosphere of the oxidation furnace 10 is opened. An air flow is maintained in the deflecting region 24 through the other air infeed boxes 50, wherein the reduction in the fresh air fed in causes ambient air to be drawn in by suction, indicated in FIG. 3 by an arrow P1. The ambient air flows into the deflecting region 24 and past the deflecting roller 32*b*.

As a result, the deflecting roller 32*b* and the fibres 20 guided over it are cooled. When the loose end of the torn fibre 20 arrives at the deflecting roller 32*b*, it can be picked up at a moderate temperature by a maintenance person and linked with an adjacent fibre 20.

So that access to the deflecting region 24 can additionally be facilitated, the glass plate 62 is previously tilted into its open position, arranged in front of the deflecting roller 32*b*.

Once the torn fibre 20 has been linked with an intact fibre 20, this glass plate 62 is tilted back into its closed position and the bottommost air infeed box 50 is moved back into its operational position in front of the duct connection piece 52, which is thereupon opened again.

When the torn fibre 20 has been linked with an adjacent fibre 20, and both fibres 20 have to be laid in a particular track on each successive deflecting roller 32, a corresponding procedure can be performed in the opposing deflecting region 26. In the present case, therefore, the underside of the central deflecting roller 32*c* in the second deflecting region 26 must first be accessed. For this purpose, in the next step the air infeed box 50 which is bottommost there is moved into its maintenance position and the two glass plates 62 are tilted into their open position in front of the deflecting rollers 32*a* and 32*c*. This can also be seen in FIG. 3. The cooler ambient air which is now drawn in by suction is illustrated by an arrow P2.

This procedure can be performed analogously and successively for the two deflecting rollers 32*d*, in the first deflecting region 24, and 32*e*, in the second deflecting region 26, which follow as seen in the direction in which the fibres 20 run.

Further exemplary embodiments of the oxidation furnace 10 will be explained below, in which the same components also bear the same reference numerals. Unless otherwise explicitly described, the statements made above in relation to the oxidation furnace 10 according to FIGS. 1 to 4 apply accordingly to all the exemplary embodiments below.

Figure 5:
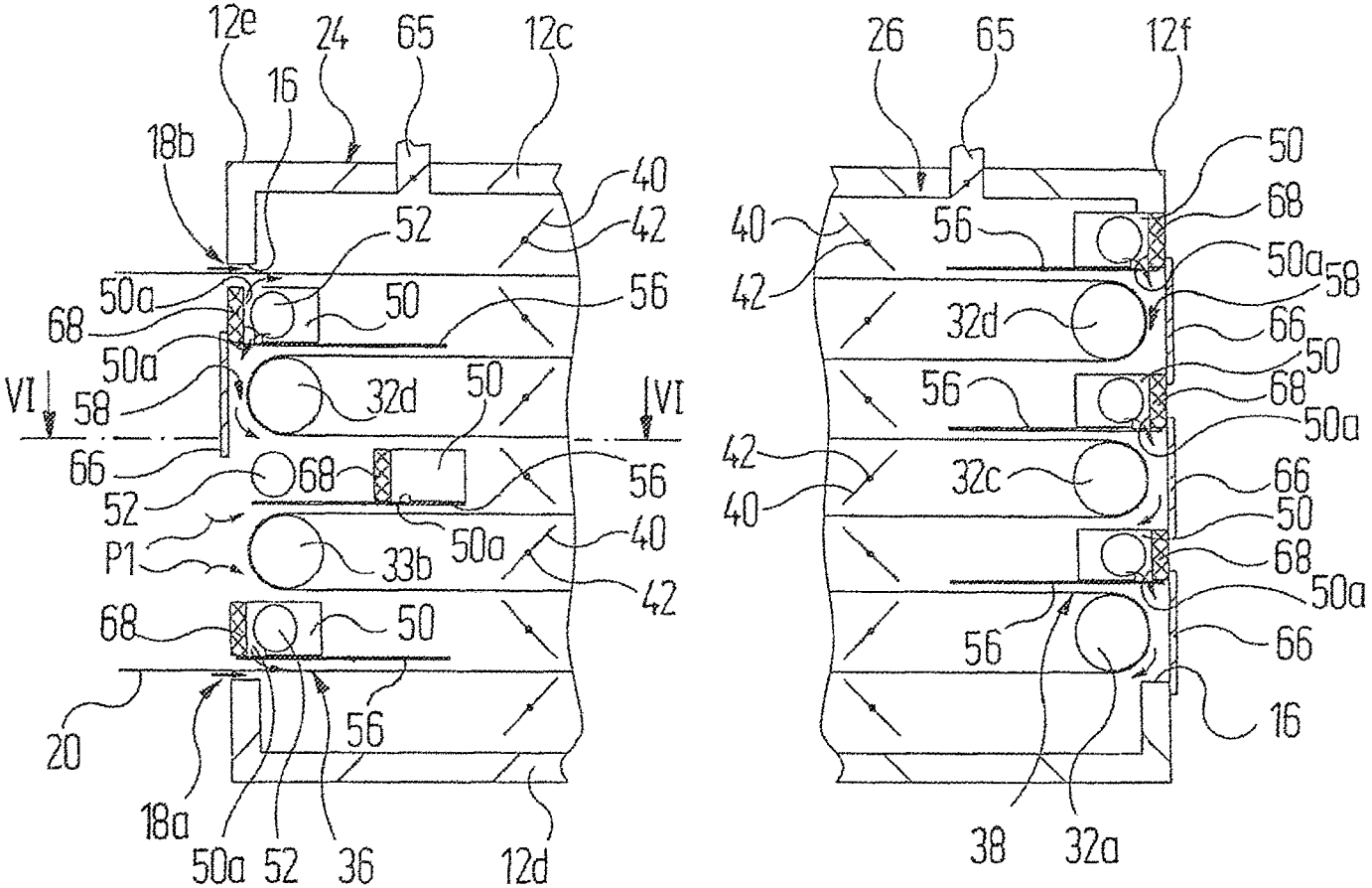
FIG. 5 shows vertical sections, corresponding to the sections in FIG. 3, through deflecting regions at opposing ends of an oxidation furnace, according to a second exemplary embodiment.
Figure 6:
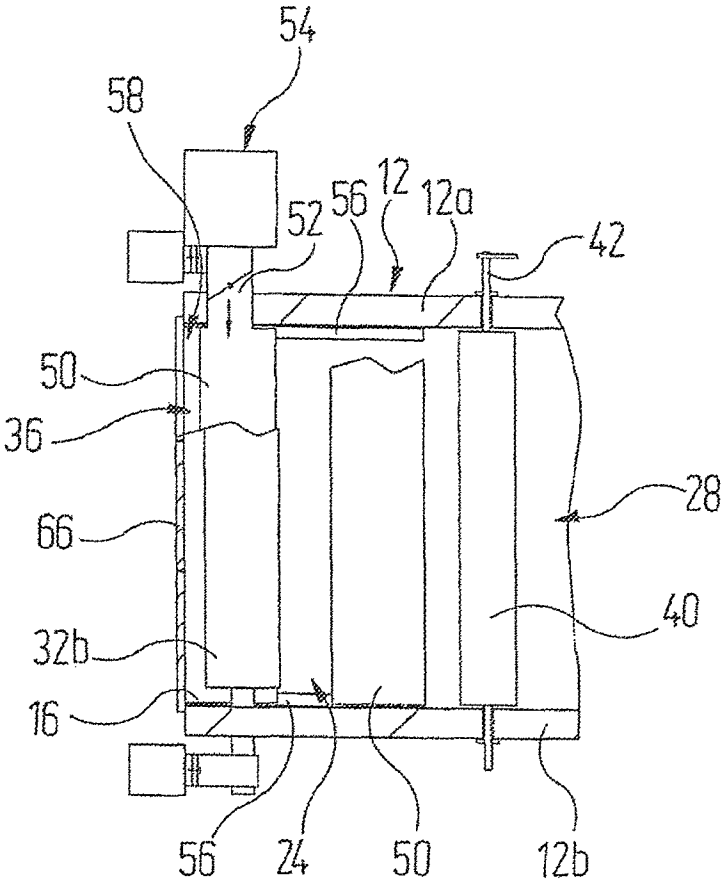
FIG. 6 shows a horizontal section through an airlock deflecting region according to FIG. 5, along the line of section VI-VI there, wherein infeed blower boxes are shown partly cut away.

In FIGS. 5 and 6, modified deflecting regions 24 and 26 of the oxidation furnace 10 are shown as a second exemplary embodiment. There, instead of the tiltable glass plates 62, removable glass plates 66 are present, which are mounted in holding frames (not shown individually). There is a thermal insulation means 68 (visible in FIG. 5) on the air infeed boxes 50, and this provides insulation from the ambient atmosphere of the oxidation furnace 10 in the operational position of the air infeed boxes 50. At the same time, the thermal insulation means 68 may be used as a mounting for the glass plates 62.

When access from the outside to one or both of the deflecting regions 24, 26 becomes necessary, a corresponding glass plate 66 is taken out of the mounting frame. In this case, the access path is larger than with the tiltable glass plates in the first exemplary embodiment according to FIGS. 3 and 4.

Figure 7:
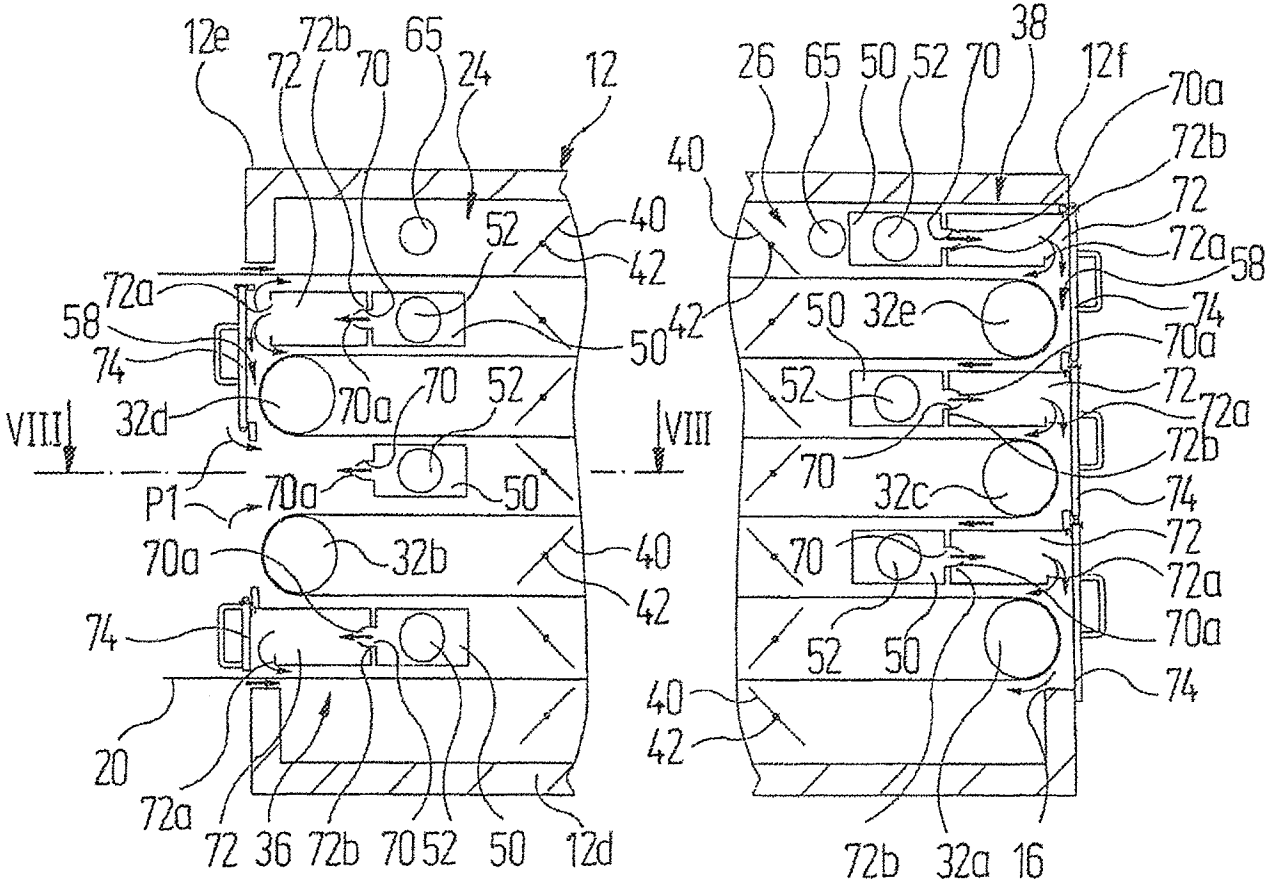
FIG. 7 shows vertical sections, corresponding to the sections in FIG. 3, through deflecting regions at opposing ends of an oxidation furnace, according to a third exemplary embodiment.
Figure 8:
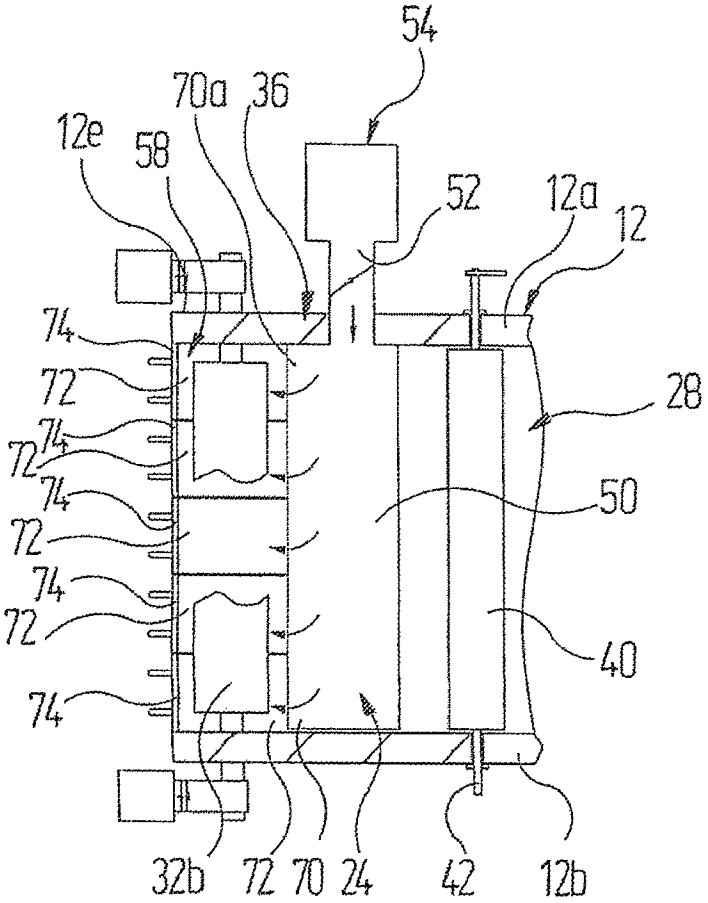
FIG. 8 shows a horizontal section through an airlock deflecting region according to FIG. 7, along the line of section VIII-VIII there, wherein a deflecting roller is shown partly cut away.

As a third exemplary embodiment, FIGS. 7 and 8 show deflecting regions 24, 26, again modified, of the oxidation furnace 10. In this case, the air infeed boxes 50 are arranged stationary and approximately centred between the respective end wall 12*e*, 12*f* and the air guide flaps 40 of the deflecting regions 24, 26. Instead of the exit slots 50*a*, the air infeed boxes 50 have on their side facing the respective end wall 12*e* or 12*f* an exit tongue 70 having an exit slot 70*a*, which extends over the entire length of the air infeed box 50.

Figure 9:
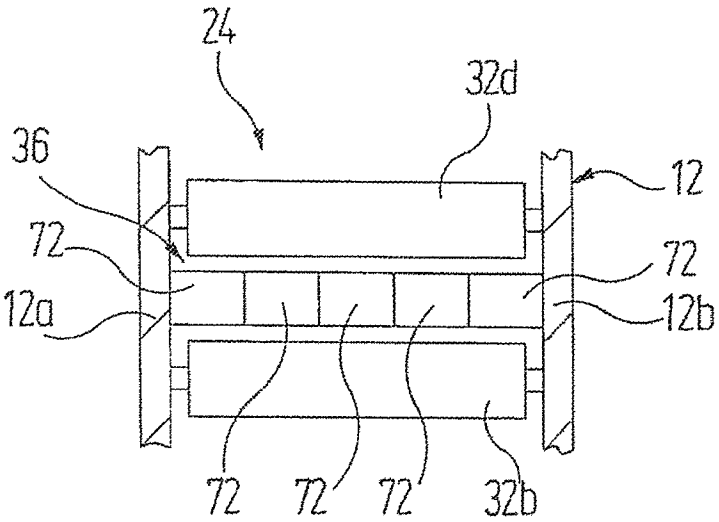
FIG. 9 shows a partial front view of the deflecting region in FIG. 8.

In each case next to the air infeed boxes 50, cuboid air guide boxes 72 are arranged in the regions above and below between the planes spanned by the carpet of fibres 20, in each case a plurality of air guide boxes 72 being next to one another in a given plane. This can be seen in FIG. 9.

On its side pointing towards the end wall 12*e* or 12*f* of the furnace housing 12, the air guide boxes 72 each have an exit slot 72*a* which corresponds to the exit slot 50*a* in the air infeed boxes 50 according to FIGS. 3 to 6 and extends in the longitudinal direction of the respective air guide box 72 and hence transversely to the direction of flow of the fresh air flowing out of the air infeed boxes 50. It is possible for fresh air that is fed in to re-emerge upwards and/or downwards through this exit slot 72*a*, as illustrated in FIG. 7 by corresponding arrows in the deflecting regions 24, 26 and. On the opposing side, the air guide boxes 72 have an inlet 72*b* which complements the exit tongue 70 of the air infeed boxes 50 and, in operation, receives it, with the result that hot fresh air from the air infeed boxes 50 flows into the air guide boxes 72 and from there flows to the side 58 of the deflecting rollers 32*a*, 32*b*, 32*c*, 32*d*, 32*e*.

The air guide boxes 72 and the deflecting rollers 32*a*, 32*b*, 32*c*, 32*d*, 32*e* are covered by means of removable glass plates 74 by means of which the furnace housing 12, once again apart from the entry and exit regions for the carpet of fibres 20, is closed in gas-tight manner. The glass plates 74 may extend largely over the entire width of the furnace housing 12 or be segmented in a manner complementing the air guide boxes 72. In the latter case, it is then possible in each case to remove only the glass plate 74 located in front of the section of the respective deflecting region 24, 26 to which access is required.

When access to one of the deflecting regions 24, 26 becomes necessary, first of all the corresponding glass plate 74 is removed. The air guide boxes 72 are fastened detachably in the deflecting regions 24, 26 as a type of suspended box, by means of fastenings (not shown individually), and can be taken out of the deflecting regions 24, 26 by way of the passages 16 and 18 in the end walls 12*e*, 12*f* of the furnace housing 12. Because a plurality of air guide boxes 72 are arranged next to one another and only a single air guide box 72 can be taken out, it is only possible to free a locally limited access region to the deflecting regions 24, 26, which does not extend over the entire width of the respective passage opening 16 or 18 in the end walls 12*e*, 12*f* but only where the loose end of the torn fibre 20 will run past.

In this way, the temperature of the fibres 20 can be maintained both above and below the section of the deflecting regions 24, 26 which is accessible from the outside, whereas the deflecting rollers 32 and the fibres 20 running thereon can cool in this section.

In this exemplary embodiment, the suction connection piece 65 is provided in the longitudinal wall 12*a*.

Instead of the exit tongue 70, which in each case extends largely over the entire width of the air infeed boxes 50, the air infeed boxes 50 may, in a modification, also have a plurality of exit lugs which are arranged next to one another and can project into the air guide boxes 72 through a respective passage therein which complements them. On each of these exit lugs there may be a closure flap which is moved in front of the exit opening of a corresponding exit lug by a spring when the air guide box 72 associated with this exit lug is taken out. When this air guide box 72 is brought back into its position in front of the air infeed box 50, this closure flap is pushed aside in opposition to the spring force, with the result that the air path through the exit lug and into the air guide box 72 is free.

Figure 10:
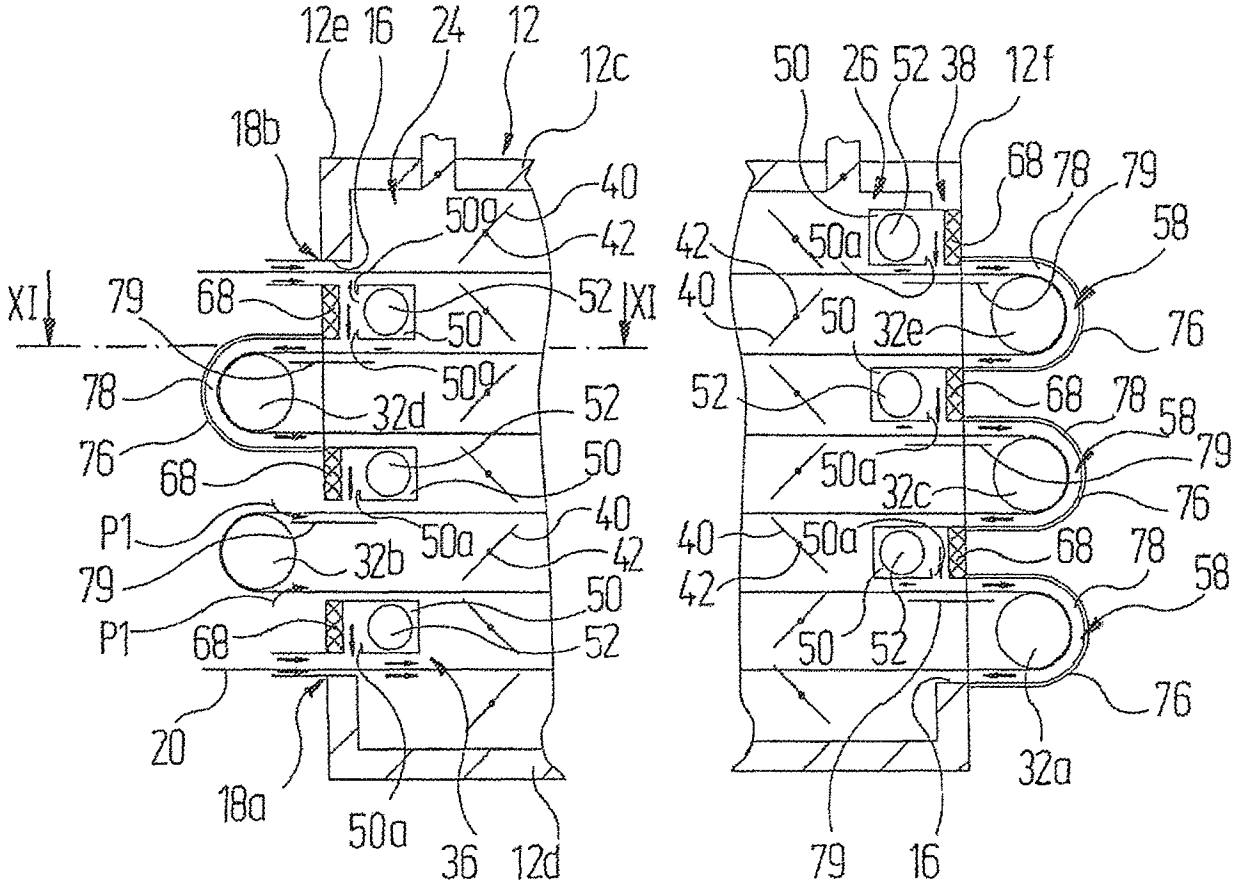
FIG. 10 shows vertical sections, corresponding to the sections in FIG. 3, through deflecting regions at opposing ends of an oxidation furnace, according to a fourth exemplary embodiment.
Figure 11:
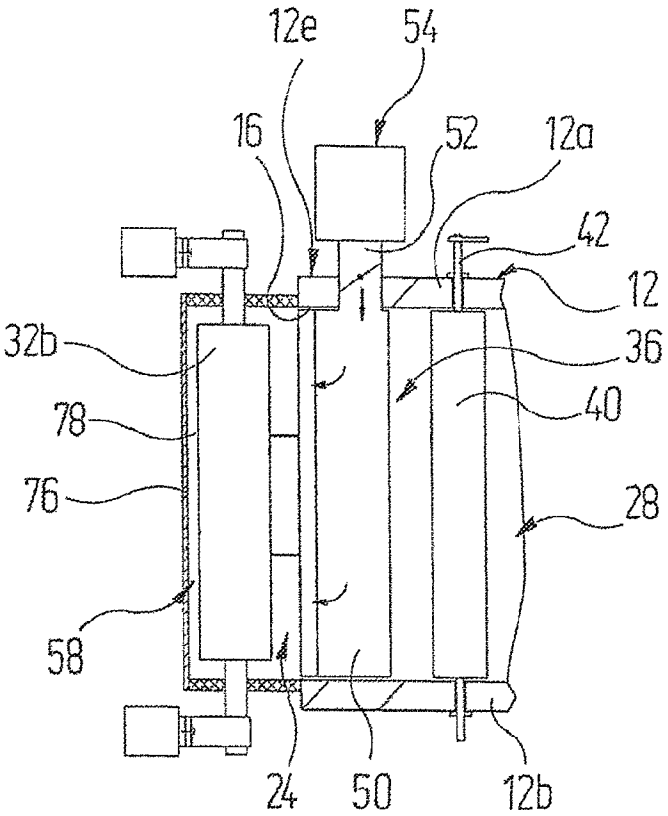
FIG. 11 shows a horizontal section through an airlock deflecting region according to FIG. 10, along the line of section XI-XI there.

As a fourth exemplary embodiment, deflecting regions 24, 26 of the oxidation furnace 10 which have again been modified are shown in FIGS. 10 and 11.

There, although the deflecting rollers 32*a*, 32*b*, 32*c*, 32*d*, 32*e* are mounted beyond the end sides 12*e*, 12*f* of the furnace housing 12, they are surrounded by removable glass troughs 76 which provide a seal against the air infeed boxes 50, here again stationary. The glass troughs 76 are slipped over the deflecting rollers 32, in each case from the side 58 of the deflecting rollers 32 remote from the process chamber 28.

A flow duct 78 is formed in each case between the glass troughs 76 and the deflecting rollers 32*a*, 32*b*, 32*c*, 32*d*, 32*e* and the fibres 20 running thereon. On the side of a plane of the carpet of fibres 20 which is remote from an air infeed box 50, there is in each case an impact plate 79, so that hot air from the air infeed boxes 50 meets the fibres 20 and the impact plate 79 lying underneath and arrives in the flow duct 78 and, above this, the side 58 of each deflecting roller 32*a*, 32*b*, 32*c*, 32*d*, 32*e* that is remote from the process chamber 28.

When access is required to one of the deflecting regions 24, 26, a corresponding glass trough 76 is removed, as shown by way of example in the case of the deflecting roller 32*b* in the deflecting region 24. The relevant deflecting roller 32 can then cool in the ambient atmosphere of the furnace housing 12, so that the fibres 20 can be handled by a maintenance person. Moreover, when the duct connection piece 52 is closed, ambient air is drawn by suction into the deflecting region 24 or 26 and there ensures that the fibres 20 around which the ambient air flows cool down.

Figure 12:
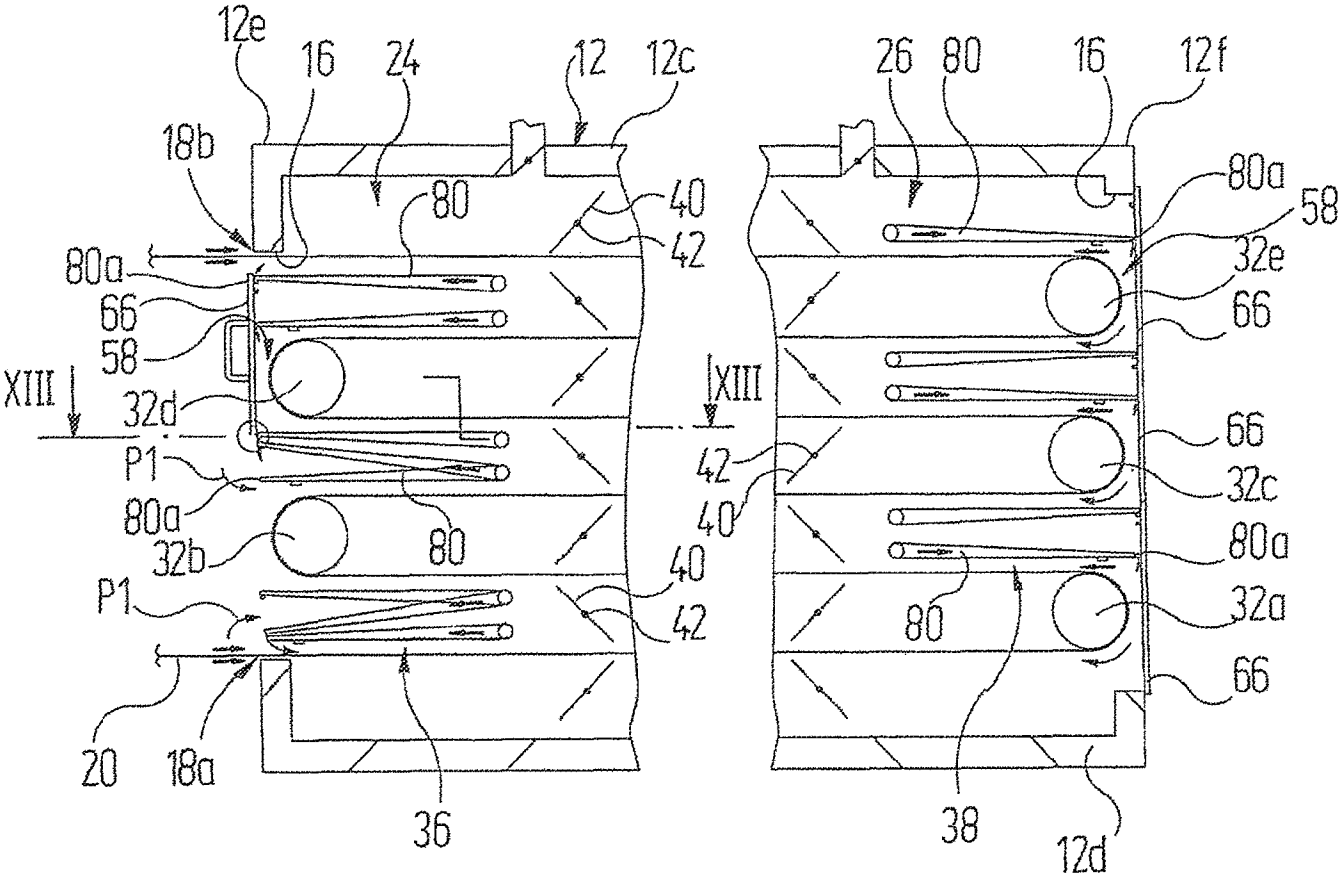
FIG. 12 shows vertical sections, corresponding to the sections in FIG. 3, through deflecting regions at opposing ends of an oxidation furnace, according to a fifth exemplary embodiment.
Figure 13:
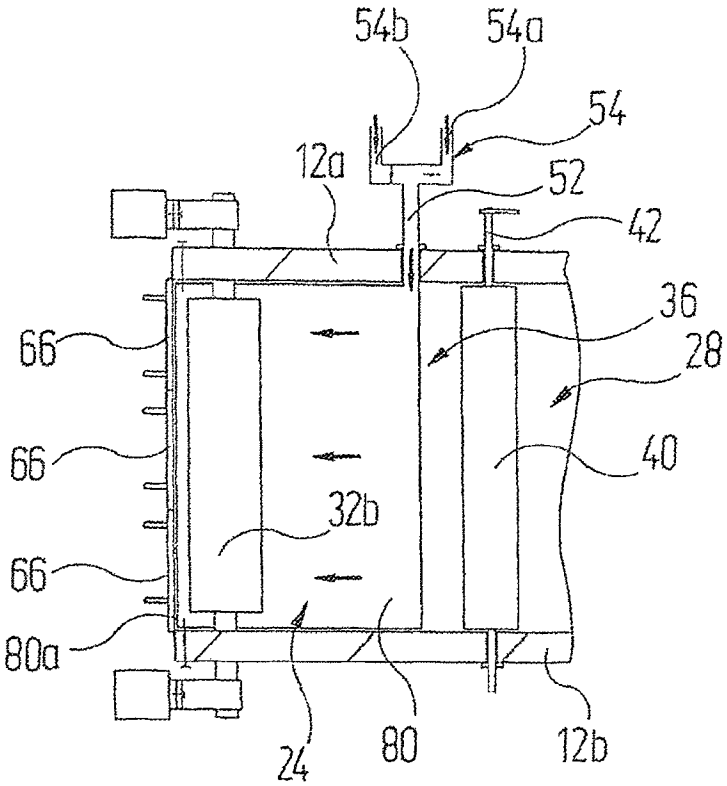
FIG. 13 shows a horizontal section through an airlock deflecting region according to FIG. 12, along the line of section XIII-XIII there.

FIGS. 12 and 13 show, as a fifth exemplary embodiment, deflecting regions 24, 26 of the oxidation furnace 10 which have again been modified.

There, the fresh air source 54 does not feed displaceable or stationary air infeed boxes but pivotal damper blades 80 which extend in the space between the planes of the carpet of fibres 20 and between the longitudinal walls 12*a*, 12*b* of the furnace housing 12. In FIG. 12, for the sake of clarity only some damper blades 80 have been provided with a reference numeral.

The damper blades 80 have an exit slot 80*a* through which hot air is emitted on the side 58 of the deflecting rollers 32*a*, 32*b*, 32*c*, 32*d*, 32*e* remote from the process chamber 28. On the side remote from the exit slot 80*a*, the damper blades 80 are mounted to be pivotal about a horizontal axis. The damper blades 80 may adopt an operational position, in which the respective exit slot 80*a* is in close proximity to an associated plane of the carpet of fibres 20. The damper blades 80 may be pivoted out of this operational position and into a maintenance position, in which the respective exit slot 80*a* lies further away from the associated plane of the carpet of fibres.

Taking the example of the two damper blades 80 which flank the carpets of fibres 20 guided by the deflecting roller 32*a*, both positions are illustrated in FIG. 12. The other damper blades 80 shown in FIG. 12 adopt their operational position.

In this exemplary embodiment, the passages 16 at the end sides 12*e*, 12*f* are once again closed by removable glass plates 66. A glass plate 66 which is arranged in front of the deflecting roller 32*b* during normal operation of the oxidation furnace 10 is not shown in FIG. 12. Here too, the glass plates 66 may again be segmented, as indicated in FIG. 13.

When access is necessary to a deflecting roller 32 and the fibres 20 guided over it, the corresponding glass plate 66 is removed and the damper blades 80 that flank the associated deflecting roller 32 above and below it are pivoted into their maintenance position. Thus, access to the fibres 20 becomes possible and the hot air is guided away from the fibres 20 which have been made accessible. Where appropriate, the feeding of hot fresh air to the relevant damper blades 80 may also be interrupted for the duration of access, or the hot air may be replaced by cool air.

In the exemplary embodiment according to FIGS. 12 and 13, optionally hot air from a duct 54*a* or cool air from a duct 54*b* may be fed to the damper blades 80 by way of the fresh air source 54. In the event of access from the outside, the relevant deflecting roller 32 may be cooled more quickly by cool air than if this measure is absent.

Figure 14:
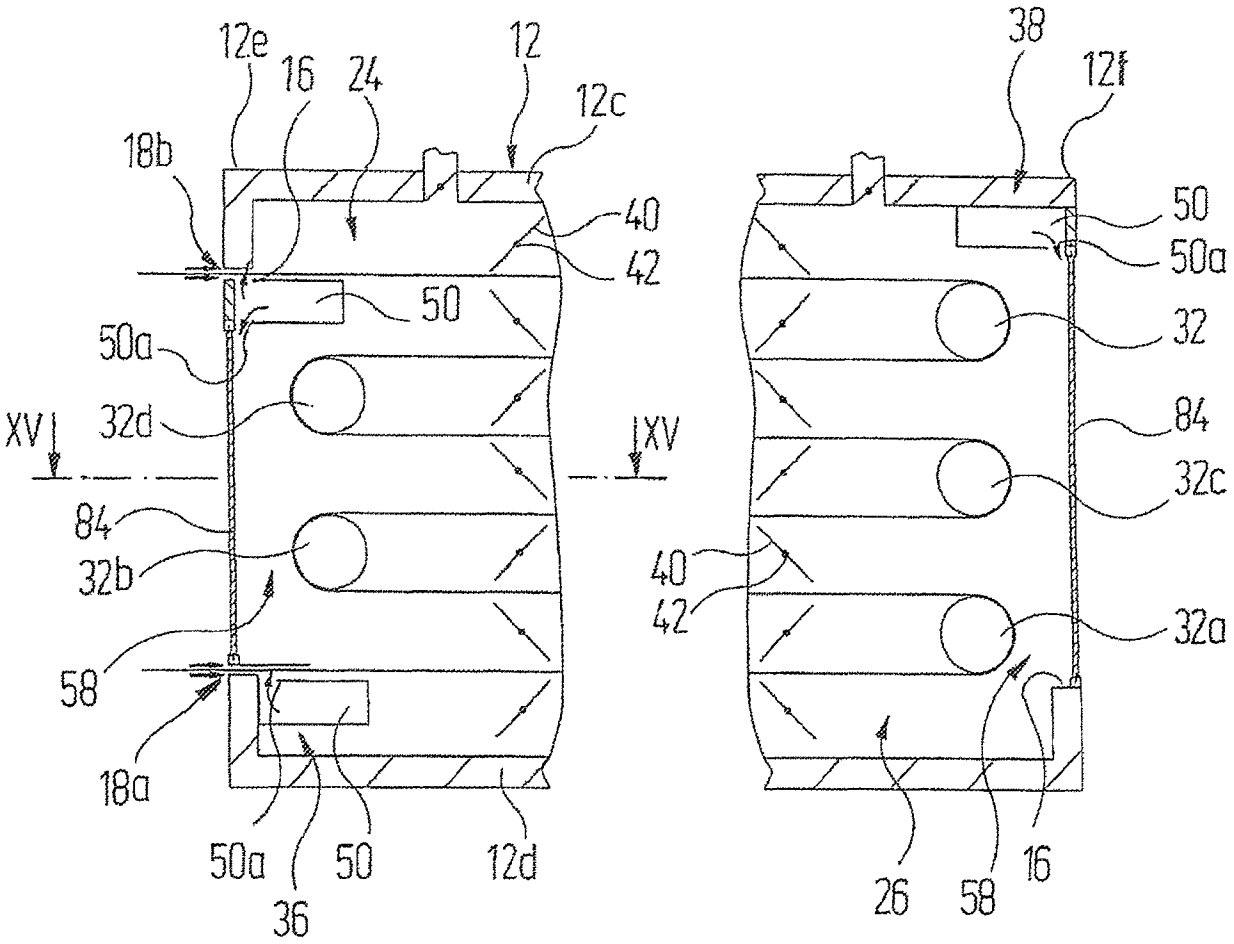
FIG. 14 shows vertical sections, corresponding to the sections in FIG. 3, through deflecting regions at opposing ends of an oxidation furnace, according to a sixth exemplary embodiment.
Figure 15:
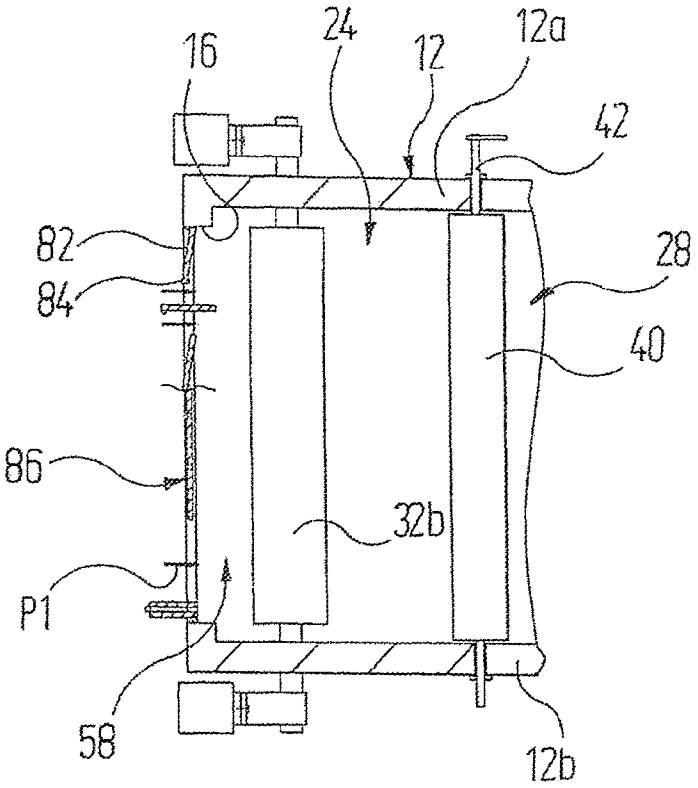
FIG. 15 shows a horizontal section through an airlock deflecting region according to FIG. 14, along the line of section XV-XV there.

A corresponding construction of the fresh air source 54 is also possible in all the other exemplary embodiments described. FIGS. 14 and 15 show, as a sixth exemplary embodiment, deflecting regions 24, 26 of the oxidation furnace 10 which have again been modified.

As can be seen in FIG. 14, there only a total of three air infeed boxes 50 are present. In the first deflecting region 24 there is arranged, at a level below the topmost plane of the carpet of fibres 20, an air infeed box 50 which has two exit slots 50*a*, so that hot air is emitted upwards and downwards. A further air infeed box 50 having an upwardly directed exit slot 50*a* is arranged in the first deflecting region 24 at a level below the bottommost plane of the carpet of fibres 20. In the second deflecting region 26, by contrast, there is only a single air infeed box 50; this is arranged at a level above the topmost plane of the carpet of fibres 20 and has a downwardly directed exit slot 50*a*.

In this variant, the passages 16 and 18 in the end walls 12*e*, 12*f* of the furnace housing 12 are closed by fins 84 of glass which extend vertically and are rotatable about a vertical axis of rotation 82, and which may be moved independently of one another. In FIG. 15, only two of these glass fins have been provided with a reference numeral.

When access to one of the deflecting regions 24, 26 becomes necessary, the corresponding glass fin 84 is rotated. As a result of the corresponding opening, ambient air is drawn by suction into the respective deflecting region 24, 26, as described above, as a result of which the section of the deflecting rollers 32*a*, 32*b*, 32*c*, 32*d*, 32*e* around which this cooler ambient air flows and the fibres 20 running thereon are cooled to a temperature at which they may be handled.

As an alternative, instead of individual mounted fins 84, it is also possible to use a folding wall 86 which may also comprise a plurality of separate folding elements, as shown in FIG. 15 in a region of the passage 16 through the deflecting region 24.

The glass plates 62, 66 and 74 and the glass troughs 76 and the glass fins 84 in the respective exemplary embodiments form housing elements of the furnace housing 12, by which the deflecting rollers 32 may be screened from the ambient atmosphere of the oxidation furnace 10 on their side 58 respectively remote from the process chamber 28.

Instead of glass, another material, where appropriate also an opaque material, may also be used for corresponding plates, troughs and fins.

If performance of the process demands it, the fibres 20 may also be heated by the hot air from the air infeed device 36, 38 in the deflecting regions 24, 26 to a temperature above the actual process temperature in the process chamber 28.

During the oxidation of carbon fibres, two or more oxidation furnaces are frequently connected one after the other in the direction in which the fibres run, it being possible for the furnaces to succeed one another in a plane or to be arranged one above the other. In this case, the exit opening for the fibres of a first furnace may be connected by way of a gas-tight duct to the entry opening of a second furnace, so that cooling of the fibres is also prevented on their path from one furnace to the next.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An oxidation furnace for the oxidative treatment of fibres comprising:

a) a housing which, apart from passage regions for carbon fibres, is gas-tight;

b) a process chamber-located in an interior of the housing;

c) at least one air infeed device which blows hot air into the process chamber;

d) deflecting rollers which flank the process chamber and guide the fibres, in the form of a carpet, through the process chamber next to one another in serpentine manner, with the carpet of fibres spanning a respective plane between opposing deflecting rollers, wherein e) the air infeed device is configured such that hot air is fed to a side of the deflecting rollers remote from the process chamber, and hot air there flows over the respective deflecting roller and the fibres before it enters the process chamber.

2. The oxidation furnace according to claim 1, wherein the deflecting rollers are arranged in a deflecting region of the housing which is separated, at least from a point of view of fluid mechanics, from the process chamber.

3. The oxidation furnace according to claim 2, further comprising: flow guide means between the deflecting region and the process chamber.

4. The oxidation furnace according to claim 1, wherein the deflecting rollers can be screened from an ambient atmosphere of the oxidation furnace by a housing element.

5. The oxidation furnace according to claim 4, wherein the housing element is arranged on the side of the deflecting rollers remote from the process chamber such that a flow channel for hot air is formed between the housing element and the deflecting roller.

6. The oxidation furnace according to claim 4, wherein the housing element is made from glass.

7. The oxidation furnace according to claim 4, wherein access from an outside to at least one deflecting roller is freed by the housing element.

8. The oxidation furnace according to claim 4, wherein at least one housing element is a plate that is mounted to pivot about a horizontal axis.

9. The oxidation furnace according to claim 4, wherein at least one housing element is a detachably fastened removable plate.

10. The oxidation furnace according to claim 4, wherein at least one housing element is a trough element that is slipped over the deflecting roller from the side of the deflecting roller that is remote from the process chamber.

11. The oxidation furnace according to claim 4, wherein at least one housing element is a fin-like element that is mounted to turn about a vertical axis.

12. The oxidation furnace according to claim 1, wherein the air infeed device is configured such that hot air may be fed or not fed to the side of one of the deflecting rollers remote from the process chamber, or, instead of hot air, cool air may be fed to the side of one of the deflecting rollers remote from the process chamber.

13. The oxidation furnace according to claim 12, wherein the air infeed device includes a plurality of air infeed boxes which are arranged between planes of the carpet of fibres and are fed from a fresh air source.

14. The oxidation furnace according to claim 13, wherein the air infeed boxes may be displaced in a horizontal direction between an operational position, in which the air infeed boxes emit hot air to the side of the deflecting rollers remote from the process chamber, and a maintenance position which is different therefrom.

15. The oxidation furnace according to claim 13, wherein the air infeed boxes cooperate with air guidance boxes that can be removed from the deflecting region.

16. The oxidation furnace according to claim 12, wherein the air infeed device includes a plurality of flap elements which are arranged between planes of the carpet of fibres, are fed from a fresh air source and emit hot air through an exit slot, wherein the flap elements may be pivoted about a horizontal axis between an operational position, in which the exit slot is arranged close to the plane of the carpet of fibres-P, and a maintenance position, in which the exit slot lies further away from this plane.

* * * * *

UNITED STATES PATENT AND TRADEMARK OFFICE

CERTIFICATE OF CORRECTION

PATENT NO. : 9,139,936 B2
APPLICATION NO. : 13/983348
DATED : September 22, 2015
INVENTOR(S) : Meinecke et al.

It is certified that error appears in the above-identified patent and that said Letters Patent is hereby corrected as shown below:

In the Claims

At column 12, line 55, after the word -- chamber -- "-" should be deleted.

At column 14, line 28, after the word -- fibres -- "-P" should be deleted.

Signed and Sealed this
Fifth Day of April, 2016

Michelle K. Lee

Michelle K. Lee
*Director of the United States Patent and Trademark Office*